US005771022A

United States Patent [19]

Vaughan et al.

[11] Patent Number: 5,771,022

[45] Date of Patent: Jun. 23, 1998

[54] COMPOSITE ANTENNA FOR HAND HELD OR PORTABLE COMMUNICATIONS

[75] Inventors: Rodney Vaughan; Neil Scott, both of Wellington, New Zealand

[73] Assignee: Industrial Research Limited, Wellington, New Zealand

[21] Appl. No.: 586,707

[22] PCT Filed: Jul. 29, 1994

[86] PCT No.: PCT/NZ94/00077

§ 371 Date: Apr. 25, 1996

§ 102(e) Date: Apr. 25, 1996

[87] PCT Pub. No.: WO95/04386

PCT Pub. Date: May 9, 1995

[30] Foreign Application Priority Data

Jul. 29, 1993 [NZ] New Zealand ..... 248283

[51] Int. Cl.[6] ..... H01Q 1/24; H01Q 21/06

[52] U.S. Cl. ..... 343/702; 343/893

[58] Field of Search ..... 343/702, 893, 343/846, 725, 729, 751, 853; H01Q 1/24, 21/06, 21/12, 21/24

[56] References Cited

U.S. PATENT DOCUMENTS 4,396,920 8/1983 Grimberg et al. ..... 343/846

4,494,120 1/1985 Garay ..... 343/702

FOREIGN PATENT DOCUMENTS

| | | |
|---|---|---|
| 520 564 | 6/1992 | European Pat. Off. . |
| 2 605 148 | 10/1986 | France . |
| 2 155 016 | 5/1973 | Germany . |
| 30 46 255 | 10/1981 | Germany . |
| 42 21 121 | 10/1993 | Germany . |
| 1 383 976 | 10/1972 | United Kingdom . |
| 1 390 728 | 4/1975 | United Kingdom . |
| 2 079 063 | 6/1981 | United Kingdom . |

*Primary Examiner*—Hoanganh T. Le
*Attorney, Agent, or Firm*—Lowe, Price, LeBlanc & Becker

[57] ABSTRACT

A composite antenna for hand held communications applications comprising at least two individual antennas spaced from each other at less than 0.3 wavelengths relative to the frequency to be received. Preferably the individual antennas are arranged in two or more arrays each of 2, 3, 4, 5 or more individual closely spaced antennas. Preferably each of the individual antennas is between 0.1 and 0.7 wavelengths long and most preferably about 1/4 wavelengths long. The composite antenna may be designed to operate in the 800 MHz to 5 GHz range. Preferably the individual antennas are spaced from each other in the direction of orientation of the individual antennas to assist in each individual antenna receiving a signal as uncorrelated as possible to the signal received by the other individual antennas of the composite array.

10 Claims, 5 Drawing Sheets

COMPOSITE ANTENNA FOR HAND HELD OR PORTABLE COMMUNICATIONS

FIELD OF INVENTION

The invention comprises an antenna particularly for a hand held or portable communications terminal.

BACKGROUND

In mobile communications, the radio link is usually non-line-of-sight. The information-bearing radio waves travelling between the terminals undergo multiple path propagation. The result is short-term signal fading, caused by wave interference, combined with long-term fading caused by "shadowing" of the waves by objects of several-wavelength dimension, such as people, trees, buildings, and hills, etc. The short-term fading occurs on average every half-wavelength, which, for example, at the newly allocated personal mobile communications frequencies of 1.5 to 1.7 GHz, is about every 10 cm. The short-term fading of the signal envelope is approximately Rayleigh-distributed. The long-term fading occurs over several wavelengths and is approximately log-normal distributed. The fading impairs the capacity, or quality, of the communications channel.

A well known technique to mitigate the effects of fading is by using antenna diversity with a signal combiner.

A well known form of diversity antenna is space diversity, in which similar elements are spaced apart by a half-wavelength or more.

Further, for hand held terminals, up to two antenna elements can be configured using polarization diversity. The polarization diverse antenna requires a monopole antenna and a collocated loop antenna—i.e., the loop is located around the monopole.

The idea of diversity antennas is to receive "uncorrelated signals". For the Rayleigh distributed short term fading, this can be taken to mean that "the envelopes should have short-term cross correlation coefficients of less than 0.7".

SUMMARY OF INVENTION

The present invention provides an antenna particularly suitable for a hand held or portable communications terminal.

In broad terms the invention may be said to comprise a composite antenna comprising at least two individual antennas spaced from each other at less than 0.3 wavelengths relative to the frequency to be received, on a hand held or portable communications terminal.

Preferably a composite antenna of the invention comprises multiple antennas which are spaced as closely as 0.2 or 0.15 wavelengths from each other or even less than 0.1 wavelengths, in two or more separate arrays. The individual antennas may be spaced as closely as 0.06 wavelengths for a two element array and 0.07 wavelengths for a three or more element array, relative to the frequencies to be received. The individual antennas may be regularly or irregularly spaced from each other.

Most preferably a composite antenna of the invention consists of two or more arrays of individual closely spaced antennas, with each array comprising two, three, four, five or more individual antennas.

The frequencies to be received i.e, for which the composite antenna of the invention is designed, may be any portable communications frequencies such as cellular telephone communication frequency bands, frequency bands that may be utilized for communicating between computers on a wireless network or the like. Typically the composite antenna will be designed to comprise a number of individual antennas closely spaced for frequencies in the 800 MHz to 5 GHz range, and particularly the 1.5 to 1.7 GHz range and also at about 2.7 GHz, these being international frequencies for personal communications.

Preferably each of the individual antennas making up the composite antenna comprises a monopole, but it is also possible for each of the antennas to comprise a folded monopole, a slot or loop antenna element, a patch element, a printed element or any other type of antenna type.

Preferably each of the antennas is between 0.1 and 0.7 wavelengths long relative to the received frequencies, and most preferably about ¼ wavelength long.

Preferably the individual antennas or at least some of the antennas are spaced from each other in the direction of orientation of the individual antennas to assist in each individual antenna receiving a signal as uncorrelated as possible to the signal received from the other individual antennas.

A ground plane can be added to the composite antenna to optically shadow the antenna from the head of a user in the case of a mobile phone for example, and/or to increase the effective gain of the antenna and/or to offer the impedance stability and added strength for the radome on a terminal. A conductive shield does not unduly influence the signal correlations, and may assist in decreasing signal correlation through reflection and diffraction effects between individual antennas by altering the effective receiving pattern of the antennas.

DESCRIPTION OF DRAWINGS

The accompanying drawings illustrate various preferred forms of composite antennas of the invention, by way of example and without intending to be limiting. In the drawings.

DESCRIPTION OF PREFERRED FORMS

Figure 1:
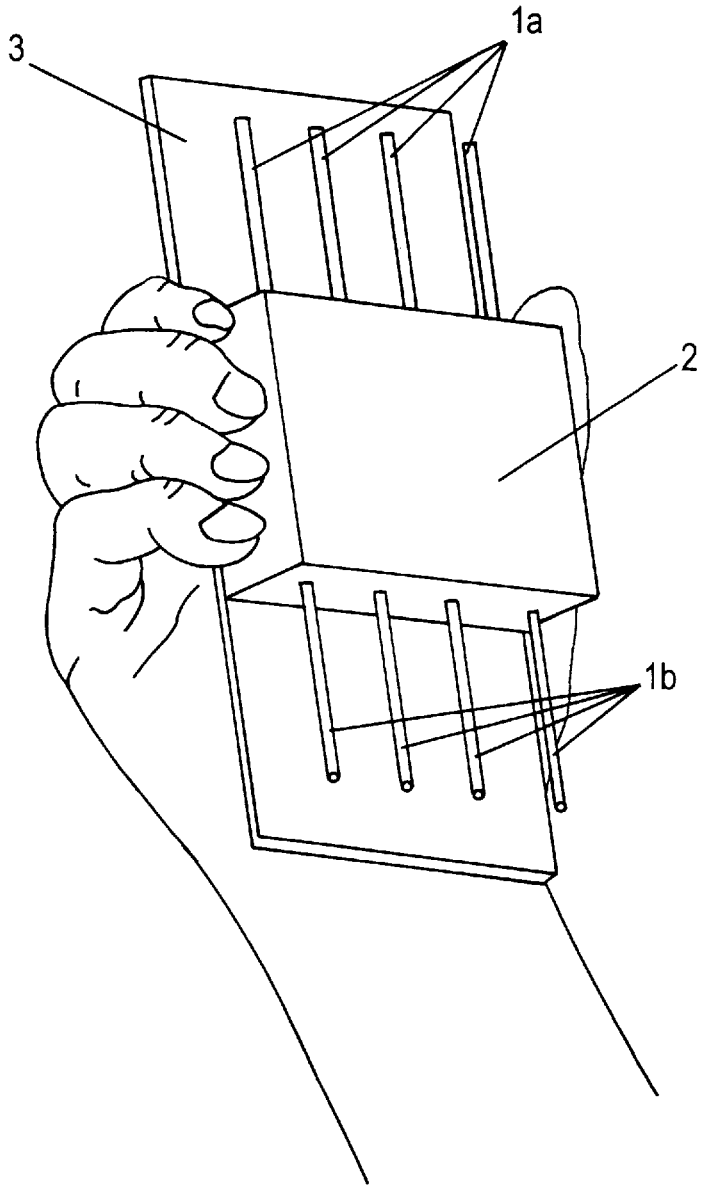
FIG. 1 shows a preferred form composite antenna of the invention comprising multiple, closely spaced monopole antennas, held in the hand.

Referring to FIG. 1, it can be seen that the composite antenna shown is small with a number of closely spaced individual antennas 1*a* and 1*b* in two arrays. The FIG. 1 configuration is particularly suitable for incorporation within the casing of a mobile telephone for example. The small size of the composite antenna enables the antenna to be incorporated completely within the casing or on the back of a mobile phone whilst maximising reception of a number of uncorrelated signals from which an improved quality received signal may be produced by combining.

The antenna array of FIG. 1 comprises eight monopole antennas arranged as a top array 1*a* and a bottom array 1*b*. Within the housing 2 the antennas are terminated and the housing also contains a combining stage for combining the uncorrelated signals from each of the individual antennas. The combining stage may utilise any suitable combining technique such as switched or selection combining, equal gain or maximum ratio combining carried out pre- or post-detection, optimum combining or the like. For optimum reception, the signals from each of the individual antennas should be used simultaneously. The antennas should all be permanently terminated, rather than switched to open-circuit conditions during the combination process. This means that there is always mutual coupling between the individual antennas. While this reduces the mean received power, the signal fading, which can limit the channel capacity independently of the mean power level, is reduced, and the ensuing channel capacity limitation can in turn be reduced.

A ground plane 3 is optionally provided behind the antennas.

A composite antenna of the invention as shown in FIG. 1 was constructed scaled for operation at a receive frequency of 1.5 GHz. Each of the monopole antennas 1*a* and 1*b* was ¼ wave length long for 1.5 GHz and each antenna was spaced from the adjacent antenna(s) by 0.07 wave length. The cross-correlation between signals received from any top array element 1*a* and any bottom array element 1*b* was found to be small, owing to their separation in the direction of the individual antenna orientation. The limiting spacing is between adjacent individual antennas. The composite antenna of FIG. 1 has been measured at 851 MHz, and the short term cross-correlation co-efficients of the envelopes were around or less than 0.7 and the results are shown in the table below. These experiments were undertaken in an indoor environment, where there was often a direct line of sight between terminals. This situation offers nominally less fading than in a non-line of sight situation, so the example is worst case in the sense that the cross-correlation coefficients in Table 1 will be at the high end for normal operating conditions.

TABLE

| | Theory (figure 2) (Rayleigh signals only) | Experimental (Short-term coefficient) |
|---|---|---|
| $R_{12}$ | 0.7 | 0.46–0.75 |
| $R_{23}$ | 0.6 | 0.49–0.64 |

Figure 2:
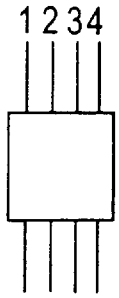
FIG. 2 shows the theoretical envelope cross-correlation coefficients for four elements of a composite antenna similar to that of FIG. 1.
Figure 2:
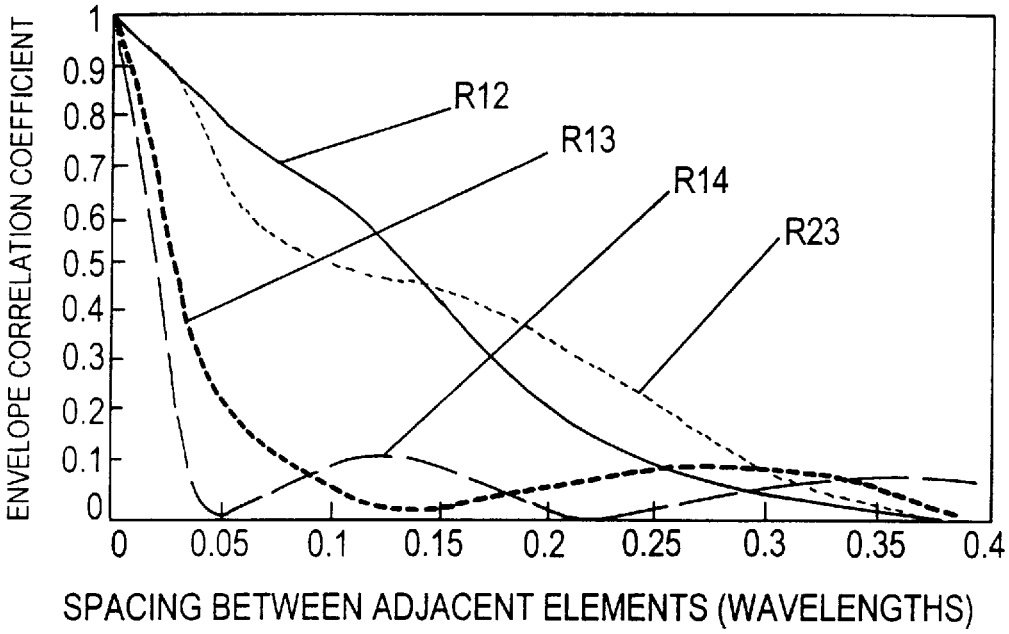

FIG. 2 shows the envelope cross-correlation coefficients for the top array of four adjacent antennas with varying individual antenna spacing. In FIG. 2 $R_{12}$ denotes the outer adjacent pairs, $R_{13}$ the spaced alternate pairs, and $R_{14}$ the pair of outer antennas. It was found that for a cross-correlation coefficient of 0.7 or less, the outer most pair limit the linear spacing between individual antennas to about 0.07 wave lengths. The worst case spacing is given by the $R_{12}$ curve, i.e, that relating to outer adjacent antennas and the inner adjacent antennas $R_{23}$. The short tern correlation is less than the long term correlation, so the theoretical curves give pessimistic (i.e. large) antenna spacings. FIG. 2 is computed using assumptions for a tractable analysis and will not be exact in practice, but nonetheless offers a guide to the cross-sectional limitations.

Figure 3:
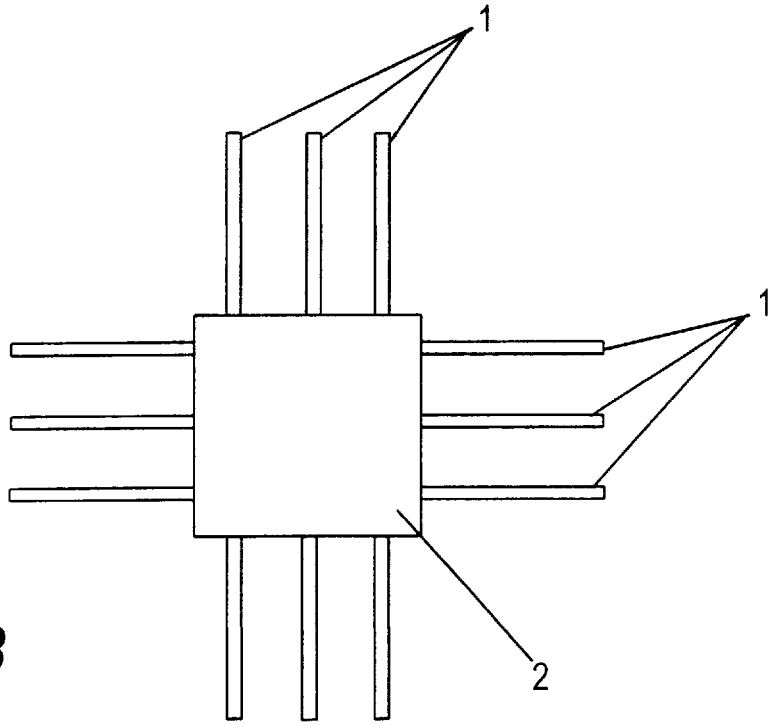
FIG. 3 shows an alternative configuration for a composite antenna of the invention comprising multiple, closely spaced monopole antennas.

FIG. 3 shows an alternative composite antenna of the invention, with four arrays of each of three individual monopole antennas about a central housing 2 oriented in four directions as shown. In a related alternative configuration, a number of individual antennas may extend radially from a circular housing. It is also not necessary that the elements all lie in a common plane.

Figure 4:
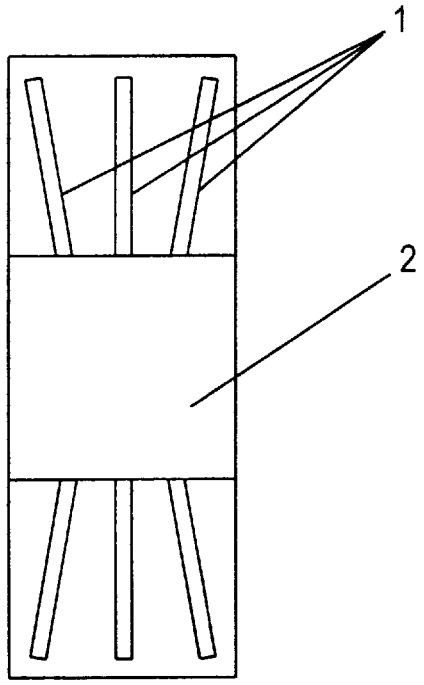
FIG. 4 shows a further alternative composite antenna of the invention comprising closely spaced monopole antennas.

FIG. 4 shows a further alternative composite antenna of the invention using sloping monopoles, which have the advantage of allowing a closer feed point spacing. Relative to the antenna of FIG. 1, the outer individual antennas in the top and bottom arrays are bent away from the central antenna but alternatively individual antennas could be bent towards each other and the bending angle can be in either the plane of the arrays, or orthogonal to that plane, or a combination thereof.

Figure 5:
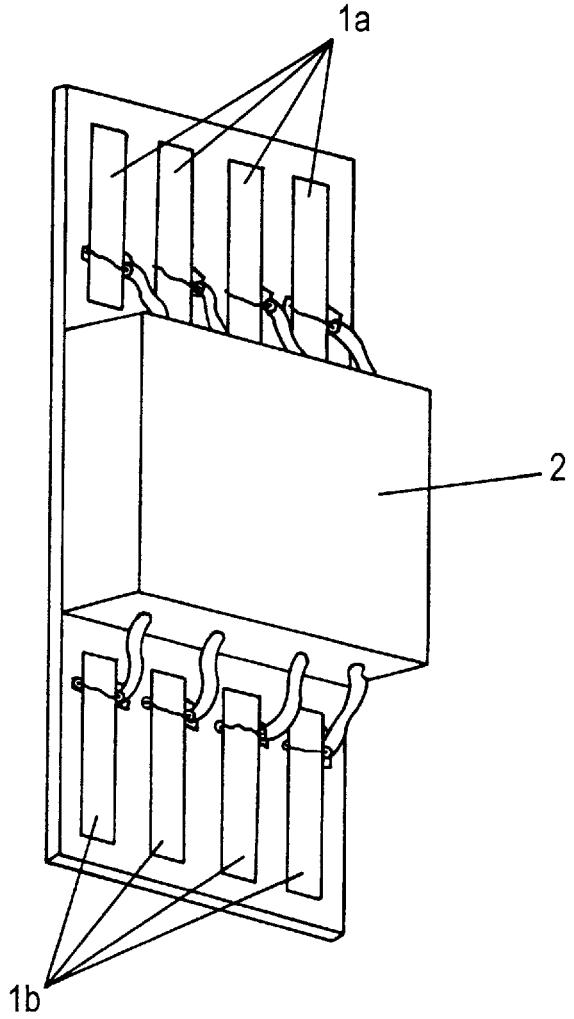
FIG. 5 shows a composite antenna of the invention similar to that of FIG. 1, but where each individual antenna comprises a slot antenna.

FIG. 5 shows a composite antenna of the invention which is similar to FIG. 1 but comprises top and bottom arrays of closely spaced slot antennas 1*a* and 1*b*. As is known for such slot antennas, the earth sheath of a coaxial feed cable can be connected to one edge of the slot antenna and the central conductor of the coaxial cable to the other edge of the slot. Such slot antennas could be angled towards or away from each other also, for example.

Figure 6:
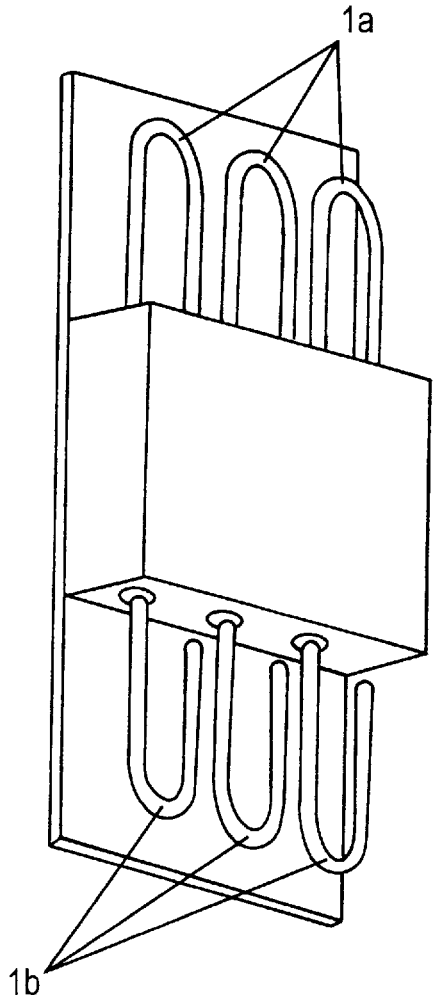
FIG. 6 shows a composite antenna generally similar to that of FIG. 1 but where the individual antennas each comprise a folded monopole antenna.

FIG. 6 shows a further composite antenna of the invention, in this case comprising a top array of three folded monopole antennas 1*a*, and a similar bottom array of antennas 1*b*.

A composite antenna of the invention may also comprise a combination of individual antennas of different types. For example an antenna array may be made up of a number of individual monopole and slot antennas, sleeved monopole antennas, or antennas of any other type. The individual antennas may be regularly or irregularly spaced.

The composite antennas of the invention with multiple closely spaced individual antennas enables multi-element antennas to be much more compact than previously. For example, a composite antenna of the invention comprising two closely spaced monopoles in fact occupies less volume than a corresponding polarisation diverse antenna. The composite antenna design of the invention is particularly suited for hand held or portable communications terminals.

The foregoing describes the invention including preferred forms thereof. Alterations and modifications as will be obvious to those skilled in the art are intended to be incorporated in the scope hereof as defined in the claims.

We claim:

1. A composite antenna comprising at least three individual antennas spaced from each other at less than 0.2 wavelengths relative to the frequency to be received and an associated combining stage which combines uncorrelated signals from each of the antennas using an antenna diversity combining technique, on a hand held or portable communications terminal.

2. A composite antenna according to claim 1, wherein the individual antennas are spaced at less than 0.15 wavelengths from each other.

3. A composite antenna according to claim 1, wherein the individual antennas are spaced at less than 0.1 wavelengths from each other.

4. A composite antenna as claimed in claim 1 wherein individual antennas are arranged in two or more separate arrays, each of three or more individual antennas.

5. A composite antenna according to claim 1, wherein each of the individual antennas making up the composite antenna comprises a monopole including a folded monopole.

6. A composite antenna according to claim 1 wherein each of the individual antennas is between 0.1 and 0.7 wavelengths long relative to the received frequencies.

7. A composite antenna according to claim 1 wherein each of the individual antennas is about ¼ wavelength long.

8. A composite antenna according to claim 1 wherein the individual antennas or at least some thereof are spaced from each other in the direction of orientation of the individual antennas to assist in each individual antenna receiving a signal uncorrelated to the signal received by the other individual antennas.

9. A composite antenna according to claim 1, including a ground plane adjacent the antennas.

10. A composite antenna as claimed in claim 1, designed for frequencies in the 800 MHz to 5 GHz range.

* * * * *